US005382140A

United States Patent [19]

Eisenbacher et al.

[11] Patent Number: 5,382,140

[45] Date of Patent: Jan. 17, 1995

[54] RADIAL-PISTON PUMP

[75] Inventors: Egon Eisenbacher, Karlstadt; Franz Pawellek, Marktheidenfeld; Bernhard Arnold, Roden-Ansbach, all of Germany

[73] Assignee: Elasis Sistema Ricerca Fiat Nel Mezzogiorno, Viale Implero, Italy

[21] Appl. No.: 16,738

[22] Filed: Feb. 11, 1993

[51] Int. Cl.[6] ..... F04B 1/04

[52] U.S. Cl. ..... 417/273; 91/491

[58] Field of Search ..... 417/273; 91/491, 493, 91/496; 123/55 AA; 92/72, 129; 74/55, 570

[56] References Cited

U.S. PATENT DOCUMENTS 4,519,299 5/1985 Moloney ..... 92/129
4,913,628 4/1990 Samland et al. ..... 417/273
5,167,493 12/1992 Kobari ..... 417/273
5,180,292 1/1993 Abousabha et al. ..... 417/273
5,213,482 5/1993 Reinartz et al. ..... 417/273

*Primary Examiner*—Richard A. Bertsch
*Assistant Examiner*—Alfred Basichas
*Attorney, Agent, or Firm*—Ladas & Parry

[57] ABSTRACT

A pump comprising a number of radial cylinders arranged a given angular distance apart about a drive shaft and each housing including a piston resting radially on a respective pad by virtue of the action of a return spring. The connection between the piston and pad comprises a retainer for preventing in-service detachment of the pad, which rests on a respective flat portion of a cam mounted for rotation on an eccentric portion of the shaft. The force on the pad produced by sliding friction between the pad and the flat portion of the cam and directed perpendicular to the axis of the cylinder is absorbed by the piston.

16 Claims, 5 Drawing Sheets

RADIAL-PISTON PUMP

BACKGROUND OF THE INVENTION

The present invention relates to a radial-piston pump comprising a number of cylinders with their respective axes arranged a given angular distance apart about a drive shaft; a number of pistons, each having an inner radial end, and each sliding inside a respective said cylinder; and a cam for activating said pistons and rotating on an eccentric portion of said shaft.

A pump of the aforementioned type is described in document EP-A-304,743, wherein provision is made for three pistons arranged radially and resting on the cam by means of a spring. As the shaft rotates, however, the piston moves in relation to the surface of the cam, the sliding friction of which results in wear and heat.

SUMMARY OF THE INVENTION

It is an object of the present invention to provide a highly straightforward, reliable radial-piston pump of the aforementioned type wherein said friction is minimized and conveniently absorbed.

According to the present invention, there is provided a radial-piston pump comprising a number of cylinders arranged a given angular distance apart about a drive shaft; a number of pistons, each having an inner radial end, and each sliding inside a respective said cylinder; and a cam rotating on an eccentric portion of said shaft; characterized by the fact that it also comprises a number of pads, each connected to one of said pistons so that said inner radial end rests on said respective pad by virtue of the action of a return spring, said pad resting on a respective flat portion of said cam, so that the sliding friction between said pad and said flat portion is directed perpendicular to said shaft; and retaining means for preventing in-service detachment of said Dad from said piston.

BRIEF DESCRIPTION OF THE DRAWINGS

A number of preferred non-limiting embodiments of the present invention will be described by way of example with reference to the accompanying drawings, in which.

DETAILED DESCRIPTION OF THE INVENTION

Figure 1:
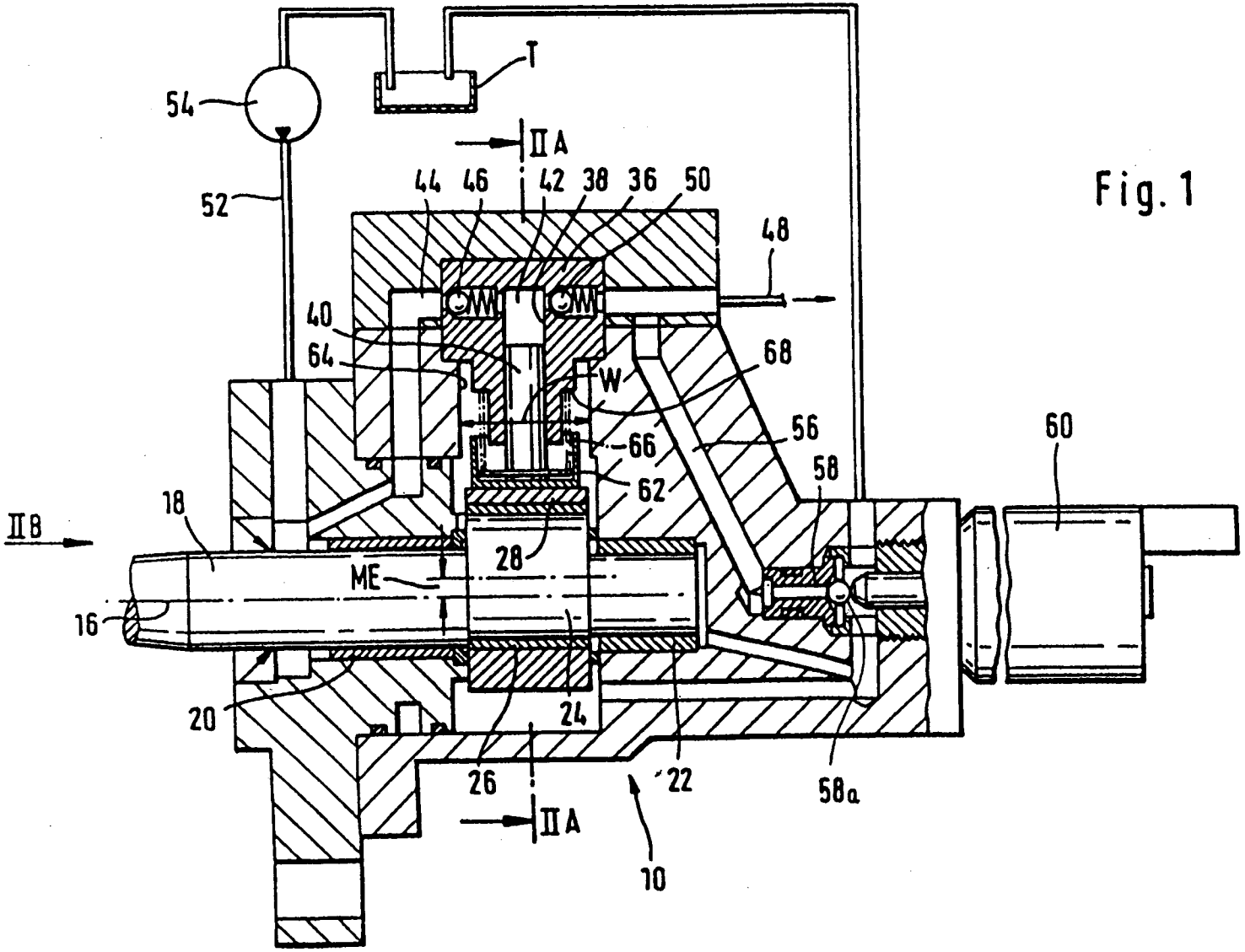
FIG. 1 shows a partially schematic, diametrical section of a radial-piston pump according to a first embodiment of the present invention.

Number 10 in FIG. 1 indicates a radial-piston pump comprising three cylinders 12-1, 12-2, 12-3 (FIGS. 2A–2B) the respective axes 41 of which are spaced radially at intervals of 120°. A respective piston 40 slides inside each cylinder 12, as described in more detail later on, and the mid planes 14 of the chambers of cylinders 12 intersect axis 16 of the drive shaft 18 of pump 10.

Shaft 18 presents an eccentric portion 24 between two friction bearings 20 and 22. Portion 24 is off-centered by distance ME in relation to axis 16, and presents a friction bearing 26 by which it is mounted for rotation inside central hole 30 of an eccentric cam 28. Cam 28 is substantially polygonal by virtue of the lateral surface presenting three flat portions 32-1, 32-2, 32-3 perpendicular to respective axes 41 of cylinders 12-1, 12-2, 12-3 and forming an angle ALPHA of 60°.

Figure 2A:
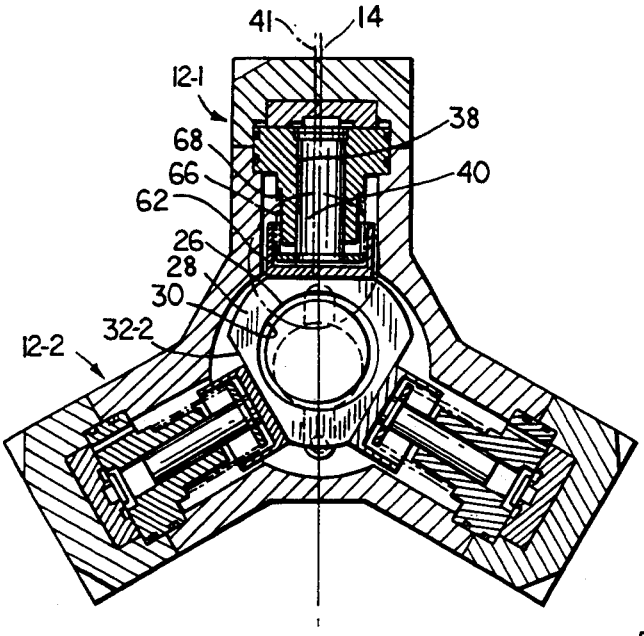
FIGS. 2A–2B show respective sections according to arrow IIB and along line IIA—IIA in FIG. 1.
Figure 2B:
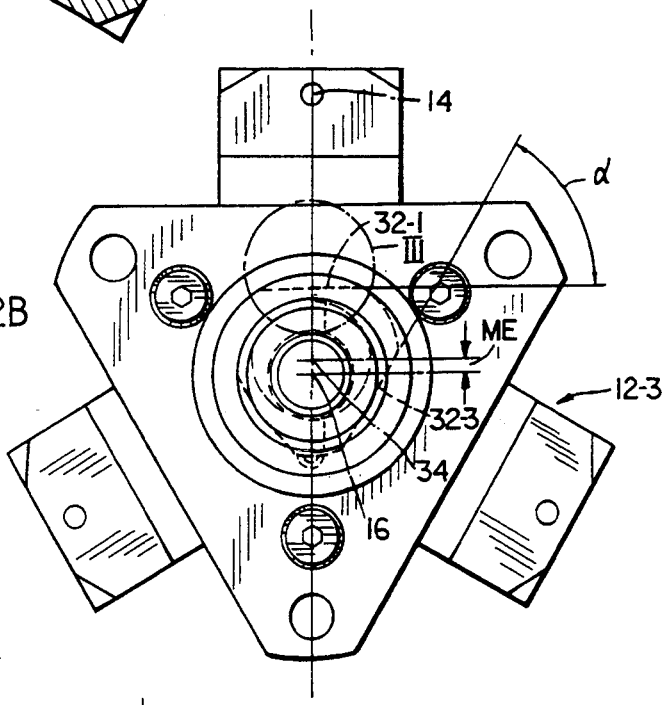

Cam 28 is maintained constantly in the angular position shown in FIG. 2A–2B by pistons 40 of pump 10. As shaft 18 rotates, the center 34 of cam 28 rotates about axis 16 along a circular path of radius ME, and each flat portion 32 of cam 28 moves parallel to itself along a circular path, so as to move pistons 40 cyclically inside respective cylinders 12.

Each cylinder 12 is fitted inside with a cylindrical insert 36 having a hole 38 coaxial with axis 41 and inside which respective piston 40 is guided in sliding manner. The front, radially-outer surface of piston 40 defines, inside hole 30, a variable-volume pumping chamber 42 (FIG. 1) having an inlet 44 housing a one-way valve 46, and an outlet 48 housing a further one-way valve 50.

Via conduit 52, inlet 44 is supplied by a higher-capacity prefeed pump 54 connected to tank T and which, via conduits not described in detail, also provides for cooling the most thermally stressed portions of pump 10, such as the bearing surfaces and valve bodies. Outlet 48 of each chamber 42 communicates with a conduit 56 connected to a pressure relief valve 58, the stopper **58*a* of which is subjected to variable pressure by means of an electromagnetic device 60 for regulating or controlling maximum fluid pressure in outlet 48**.

The inner radial end of each piston 40 presents a front surface 80 (FIG. 3) resting normally on a respective pad 62 in turn resting on a respective flat portion 32 of cam 28. Pad 62 presents a preferably circular cross section with a diameter slightly smaller than the inside diameter W (FIG. 1) of surface 64 of cylinder 12, which presents a recess for shouldering insert 36.

Piston 40 is pushed radially inwards by a return spring consisting of a preloaded helical compression spring 66 (shown by the dot-and-dash lines) resting on shoulder 68 of insert 36. Piston 40 thus follows the eccentric movement of respective flat portion 32 of cam 28, by moving radially inwards and so expanding the volume of chamber 42.

As cam 28 moves eccentrically, the friction resistance between cam 28 and each pad 62 results in a force Q perpendicular to axis 41 and which tends to shift pad 62 reciprocatingly in relation to the flat portion of cam 28. Provision must therefore be made for ensuring pad 62 is maintained axially aligned with piston 40 throughout the pumping cycle.

Figure 3:
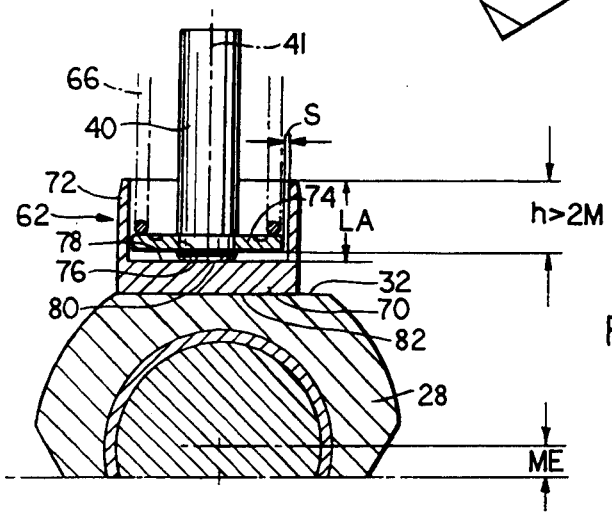
FIG. 3 shows a larger-scale view of detail III in FIG. 2.

According to the present invention, alignment of pad 62 and piston 40, and consequently absorption of the friction resistance perpendicular to the FIG. 1 plane, is achieved by respective piston 40 and guide hole 38 in insert 36. As shown in FIG. 3, pad 62 comprises a circular disk 70 forming one piece with a sleeve 72, the inside diameter of which is slightly larger than the outside diameter of a guide disk 74 fitted to piston 40.

More specifically, disk 74 is fitted in an annular groove 76 formed close to the inner radial end of piston 40, and is thus axially fixed on piston 40, and acts as a support for spring 66. Groove 76 is of minimum depth for weakening piston 40 as little as possible.

Disk 70 of pad 62 presents an outer surface 82 engaging flat portion 32 of cam 28 in sliding manner; and an inner surface 78 parallel to surface 82 and which provides for supporting flat surface 80 of piston 40.

Clearance S between the outer surface of guide disk 74 and the inner surface of sleeve 72 may be relatively ample without negatively affecting operation of pad 62. The length of sleeve 72, on the other hand, is so sized that piston 40 is surrounded at all times by sleeve 72 throughout the entire stroke of piston 40 equal to twice eccentricity ME.

Sleeve 72 thus acts as a retaining device for preventing detachment of pad 62 from piston 40, which, being independent, could be detached if the action of spring 66 fails. Detachment is also prevented in the event piston 40 jams inside hole 38 in insert 36 in the top dead center position (at the top in FIG. 1).

Figure 4:
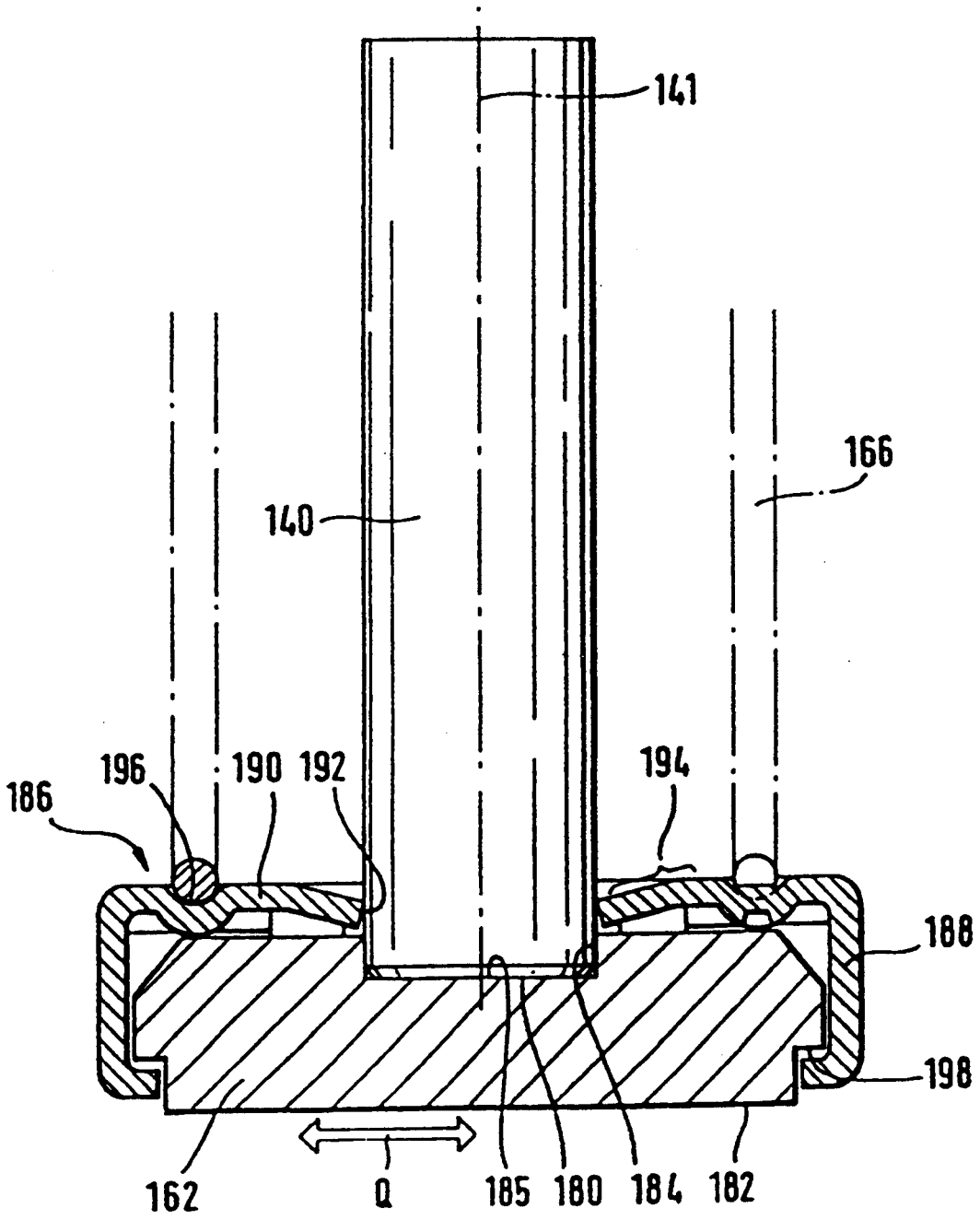
FIG. 4 shows a larger-scale section of a detail of a pump according to a further embodiment of the present invention.

According to the FIG. 4 embodiment, pad 162 consists of a circular disk, and presents a circular supporting surface 182 engaging a respective flat portion of the cam. The surface of pad 162 opposite surface 182 presents a dead hole 184 accurately housing a respective pump piston 140 consisting of a solid, externally smooth cylinder. The front surface 180 of piston 140 thus rests on the bottom 185 of dead hole 184; transverse force Q is transmitted by pad 162 to piston 140 via the lateral surface of hole 184; and piston 140 is guided accurately inside hole 38 (FIG. 2) in insert 36 of respective cylinder 12.

For preventing detachment of piston 140 (FIG. 4) and respective pad 162, provision is made for a retaining device substantially consisting of a preferably elastic retaining disk 186 substantially presenting a clamping portion 188 in the form of a sleeve. By virtue of the conical lateral surface of pad 162, the bent edge of sleeve 188 clicks on to shoulder 198 of pad 162.

Retaining disk 186 also presents a flat, elastic portion 190 having a circular seat 196 for supporting spring 166, and which also provides for fitting disk 186 on to piston 140. For this purpose, flat portion 190 presents a central opening 192 smaller in diameter than piston 140, which, when forced inside opening 192, deforms or flexes portion 194 adjacent to opening 192 in portion 190, thus providing for elastic preloading.

During operation of the pump, the cam acts on pad 162 via supporting surface 182; and, via the bottom 185 of hole 184, pad 162 transmits the action of the cam to front surface 180 of piston 140, which thus moves upwards in FIG. 4. The return stroke of piston 140 is controlled by spring 166 acting on retaining disk 186.

Portion 190 of disk 186 is so fitted on to piston 140 that the action of spring 166 on portion 190 tends to increase the pressure exerted by the edge of opening 192 on the surface of piston 140, thus safely ensuring against detachment of piston 140 and pad 162.

Figure 5:
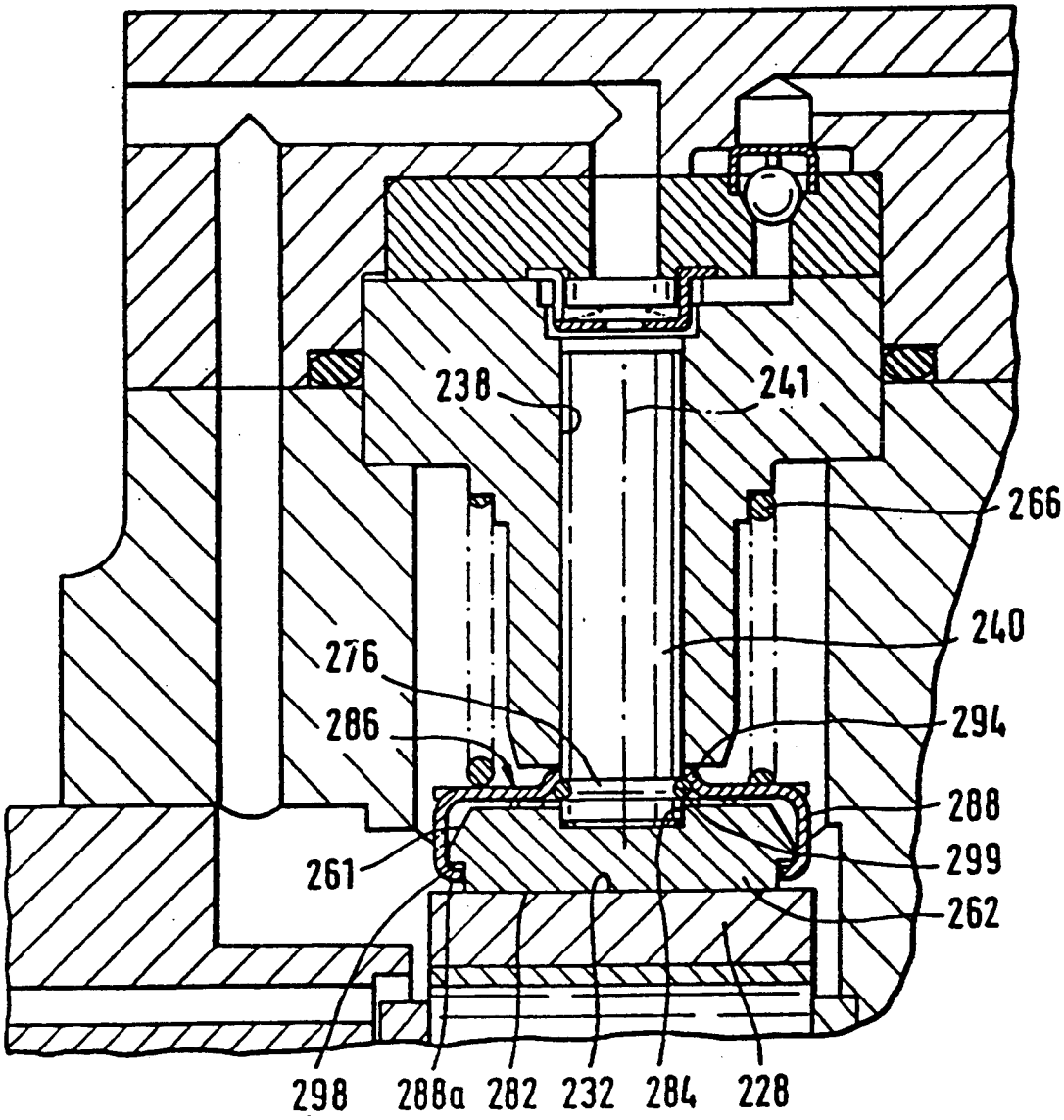
FIG. 5 shows a partial diametrical section of a pump according to a further embodiment of the present invention.
Figure 6:
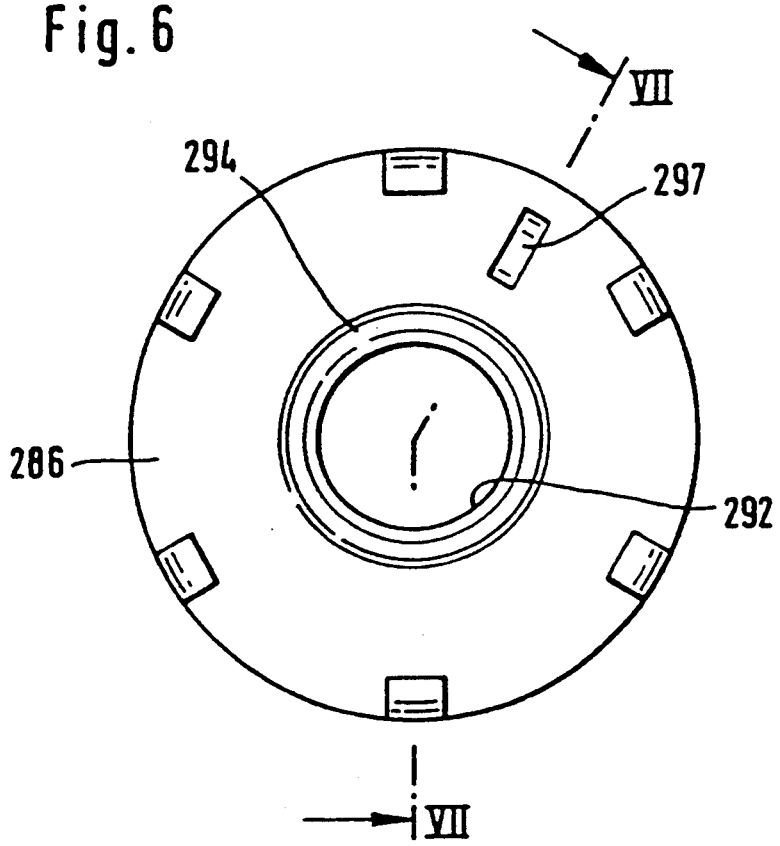
FIG. 6 shows a larger-scale front view of a detail in FIG. 5.
Figure 7:
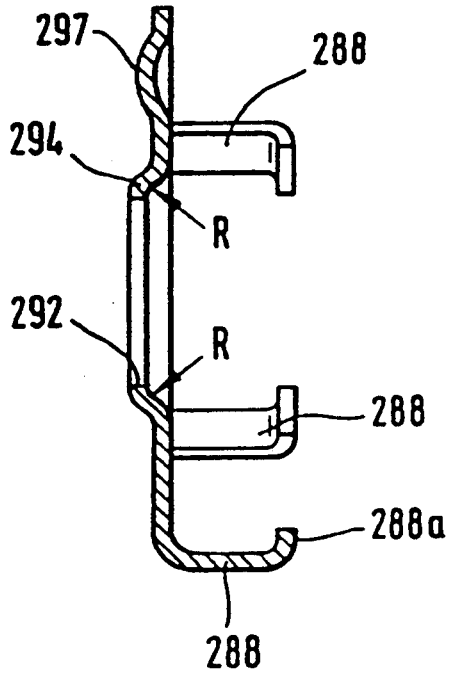
FIG. 7 shows a section along line VII—VII in FIG. 6.

FIGS. 5–7 show an embodiment similar to that of FIG. 4, and wherein pad 262 of each piston 240 consists of a circular disk with a circular supporting surface 282 engaging a respective flat portion 232 of cam 228. Pad 262 presents a dead hole 284 engaged accurately by a respective piston 240, so that the front surface of the piston rests on the bottom of dead hole 284. The force perpendicular to axis 241 of piston 240 is absorbed by the connection of piston 240 and dead hole 284.

In this case also, for preventing detachment of pad 262 and piston 240, provision is made for a retaining device consisting of an elastic disk or convex washer 286 having a number of clamping arms 288 parallel to axis 241. Each arm 288 presents a tab **288*a* bent radially inwards and which clicks on to shoulder 298 of pad 262. Washer 286 presents a central opening 292 through which piston 240 is inserted, and the edge of which is in the form of a collar 294 turned outwards (upwards in FIG. 5**) so as to form a convex angle.

Washer 286 is held axially on to piston 240 by a circular-section retaining ring 299 housed precisely inside an annular groove 276 close to the inner end of piston 240. The depth of groove 276 is such that ring 299 projects radially in relation to the lateral surface of piston 240, and collar 294 of washer 286 is force-fitted on to the projecting portion of ring 299.

FIG. 5 shows piston 240 in the top dead center position. The intake stroke of piston 240 is controlled by spring 266 resting on washer 286. By virtue of the connection of collar 294 and retaining ring 299, piston 240 is drawn radially inwards by washer 286 as flat portion 232 of cam 228 is displaced. For this purpose, no clearance should be allowed between pad 262 and piston 240, which is easily achieved by clamping pad 262 by slightly preloading tabs **288*a* of arms 288**.

As shown in FIGS. 6 and 7, retaining device 286 may easily be produced using a forming die, and by simultaneously forming the flat portion of washer 286 collar 294, and retaining arms 288, which are equally spaced about the perimeter of washer 286. Washer 286 is formed with a projection 297 projecting leftwards in FIG. 7 and on which rests one end of spring 266, which is thus locked angularly.

Collar 294 is turned upwards in FIG. 7, so as to present a radius R on the surface facing retaining ring 299, which radius R enables collar 294 to rest precisely on the projecting surface of ring 299 when pad 262 is fitted to piston 240.

To assemble retaining device 286 shown in FIGS. 5–7, ring 299 is first fitted inside groove 276 on piston 240; piston 240 is inserted through opening 292 in washer 286, until collar 294 contacts ring 299; and pad 262 is pushed inwards of device 286 so as to flex arms 288 radially, and so that tabs **288*a* slide along the conical lateral surface 261 of pad 262 and click on to shoulder 298 with a given preload. The assembly so formed may then be inserted inside hole 238** of the respective pump cylinder.

The advantages of the radial-piston pump according to the present invention will be clear from the foregoing description. Firstly, it provides, for a given piston diameter, for increasing the contact surface of the pad on the cam and for reducing the specific pressure of the same, with no need for complicated forced lubrication systems. Secondly, by virtue of the connection between the piston and pad, the transverse forces on the pad are transmitted directly to the piston, thus preventing stress from concentrating at the connections. Thirdly, any clearance between the various components is compensated for, thus extending the working life of the pump. And lastly, the pump is cheap to produce by virtue of the component parts involving only rough machining tolerances.

To those skilled in the art it will be clear that changes may be made to the embodiments described and illustrated herein without, however, departing from the scope of the present invention. For example, in the FIG. 4 embodiment, retaining disk 186 may be force-fitted on to piston 140 by means of flexible tabs separated by radial openings; groove 196 for radially positioning spring 166 may be eliminated; and portion 188 of retaining device 186, designed to click on to shoulder 198 of pad 162, may be formed differently, e.g. in such a manner as to engage an annular groove in pad 162.

We claim:

1. A radial-piston pump comprising:

a number of cylinders (12) respectively arranged a given angular distance apart about a drive shaft (18);

a number of pistons (140, 240) respectively having inner radial ends (180) and sliding inside said cylinders respectively (12);

a cam (228) rotating on an eccentric portion (24) of said drive shaft (18);

a number of pads (162, 262) respectively connected to said pistons (140, 240) so that said inner radial ends (180) thereof respectively rest on said pads (162, 262) by action of a return Spring (166, 266) and said pads (162, 262) rest on a flat portion (232) of said cam (228) so that sliding friction (Q) between said pads (162, 262) and said flat portion (232) is directed perpendicular to said drive shaft (18);

retaining means (186, 286) for preventing in-service detachment of said pads (162, 262) from said pistons (140, 240); and seats (185, 285) respectively in said pads (162, 262) for housing said inner radial ends (180, 280) of said pistons (140, 240);

wherein said pads (162,262) are circular in shape and respectively provided with shoulders (198, 298), and said retaining means comprises a retaining disk (186, 286) fitted to said pads (162, 262) and axially connected to said pistons (140, 240), said retaining disk (186, 286) comprising at least one clamping portion (188, 288) engaging said shoulders (198, 298) with a central opening (192, 292) for connection to said pistons (140, 240).

2. A pump as claimed in claim 1, characterized by the fact that said pad (162, 262) comprises at least one radial shoulder (198, 298), and said retaining disk (186, 286) is circularly symmetrical and substantially elastic so as to click on to said shoulder (198, 298).

3. A pump as claimed in claim 2, characterized by the fact that said piston (140) is force-fitted inside said central opening (192) so as to elastically deform a flat surface (194) of said retaining disk (186) at least adjacent to said central opening (192).

4. A pump as claimed in claim 1, characterized by the fact that said retaining disk (186) presents a circular seat (196) for supporting said return spring (166); said seat (196) being so formed as to radially position said return spring (166).

5. A pump as claimed in claim 2, characterized by the fact that said retaining disk (286) comprises a number of bent clamping arms (288) engaging said shoulder (298).

6. A pump as claimed in claim 5, characterized by the fact that said central opening (292) presents an edge (294) engaging a retaining ring (299) fitted axially to said piston (240) so that said retaining disk (286) is axially fixed in relation to said piston (240).

7. A pump as claimed in claim 6, characterized by the fact that said piston (240) presents a rounded-section, annular groove (276) close to said inner radial end; said retaining ring (299) being housed in said annular groove (276).

8. A pump as claimed in claim 7, characterized by the fact that the depth of said groove (276) is such that said retaining ring (299) projects from the lateral surface of said piston (240); said edge (294) comprising at least one bent portion so as to contact said retaining ring (299).

9. A pump as claimed in claim 8, characterized by the fact that said edge (294) is continuous and projects from the plane of said retaining disk (286); the entire perimeter of said edge (294) resting on said retaining ring (299).

10. A pump as claimed in claim 9, characterized by the fact that said retaining disk (286) presents a projection (297) for preventing rotation of said return spring (266).

11. A pump according to claim 1, wherein said cylinder (12) includes a cylindrical wall (64) fitted with a cylindrical insert (36), said insert (36) having a hole (238) inside which said respective piston (140, 240) is slidably guided, said disk (186,286) having a cross section with a diameter smaller than the inside diameter (W) of said cylindrical wall 64, whereby said sliding friction (Q) is absorbed solely by each of said piston (140, 240) against said insert (36).

12. A radial-piston pump comprising a number of cylinders (12) arranged a given angular distance apart about a drive shaft (18); a number of pistons (40), each having an inner radial end (80), and each sliding inside a respective said cylinder (12); a cam (28) rotating on an eccentric portion (24) of said shaft (18); a number of pads (62), each connected to one of said pistons (40) so that said inner radial end (80) rests on each of said respective pads (62) by virtue of the action of a return spring (66), said pad (62) resting on a respective flat portions (32) of said cam (28) so that the sliding friction (Q) between said pads (62) and said flat portion (32) is directed perpendicular to said shaft (18); and a guide disk (74) connected to by each of said pistons (40) and forming a shoulder for supporting said return spring (66), said pad (62) being cup shaped and including a sleeve portion (72) housing said disk (74), said portion having such a length as to prevent in-service detachment of said pad (62) from said disk (74); wherein said cylinder (12) includes a cylindrical wall (64) fitted with a cylindrical insert 36, said insert (36) having a hole (38) inside which said respective piston (40) is slidably guided, said pad (62) having a cross section with a diameter smaller than the inside diameter (W) of a said cylindrical wall 64, whereby said sliding friction (Q) is absorbed solely said piston (40) against said insert (36).

13. A pump as claimed in claim 12, wherein said cylindrical wall (64) is provided with a recess for shouldering said insert (36), a clearance (S) being provided between the outer surface of said disk (74) and the inner surface of said sleeve (72).

14. A pump as claimed in claim 12, wherein each of said piston (40) is provided with an annular groove (76) close to said inner radial end (80), said groove (76) being removably engaged by a central hole of said disk (74).

15. A pump as claimed in claim 12, wherein, an annular friction bearing (26) is mounted on said eccentric portion (24) for rotation inside a central hole (30) of said cam (28).

16. A pump according to claim 11, wherein said cylindrical wall (64) is provided with a recess for shouldering said insert (36).

* * * * *

UNITED STATES PATENT AND TRADEMARK OFFICE

CERTIFICATE OF CORRECTION

PATENT NO. : 5,382,140
DATED : January 17, 1995
INVENTOR(S) : Egon Eisenbacher, et al.

It is certified that error appears in the above-indentified patent and that said Letters Patent is hereby corrected as shown below:

On title page, left-hand column, item "73", after "mezzogiorno" insert -- Societa Consortile Per Azioni -- and change "Viale Implero" to -- Pomigliano D'Arco --.

Signed and Sealed this

Twenty-second Day of August, 1995

*Attest:*

Bruce Lehman

BRUCE LEHMAN

*Attesting Officer*

*Commissioner of Patents and Trademarks*